US008125134B2

(12) United States Patent
Shimazu

(10) Patent No.: US 8,125,134 B2
(45) Date of Patent: Feb. 28, 2012

(54) ELECTRON-EMITTING DEVICE, METHOD OF MANUFACTURING THE SAME, ELECTRON SOURCE, AND IMAGE DISPLAY APPARATUS

(75) Inventor: Akira Shimazu, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 12/481,099

(22) Filed: Jun. 9, 2009

(65) Prior Publication Data

US 2009/0322206 A1 Dec. 31, 2009

(30) Foreign Application Priority Data

Jun. 27, 2008 (JP) ..... 2008-168752

(51) Int. Cl.
*H01J 63/04* (2006.01)

(52) U.S. Cl. ..... 313/495

(58) Field of Classification Search ..... 313/495–497, 313/309–311

See application file for complete search history.

(56) References Cited

U.S. PATENT DOCUMENTS

2003/0042843 A1* 3/2003 Hachisu ..... 313/495
2005/0285497 A1 12/2005 Tamura ..... 313/310

FOREIGN PATENT DOCUMENTS

CN 1725415 A 1/2006
JP 2000-251628 A 9/2000
JP 2002-352699 12/2002

OTHER PUBLICATIONS

Notification of the First Office Action issued in the corresponding application No. 200910150571.2 by the State Intellectual Property Office of the People's Republic of China dated Jul. 6, 2010, along with its English-language translation—8 pages total.

* cited by examiner

*Primary Examiner* — Toan Ton
*Assistant Examiner* — Hana Featherly
(74) *Attorney, Agent, or Firm* — Fitzpatrick, Cella, Harper & Scinto

(57) ABSTRACT

Provided is an electron-emitting device which is excellent in electron-emitting efficiency, and may obtain a large electron-emitting amount and stable electron-emitting characteristics. The electron-emitting device includes: a first conductive film and a second conductive film which are provided through a first gap; first carbon films connected to the first conductive film; and second carbon films which are connected to the second conductive film, and are opposed to the first carbon films through second and third gaps. Continuous concave portions are provided in the second and third gaps.

3 Claims, 9 Drawing Sheets

ELECTRON-EMITTING DEVICE, METHOD OF MANUFACTURING THE SAME, ELECTRON SOURCE, AND IMAGE DISPLAY APPARATUS

BACKGROUND OF THE INVENTION

1. Field of the Invention

The present invention relates to an electron-emitting device used for a flat panel display, and a method of manufacturing the electron-emitting device, an electron source including the electron-emitting device, and an image display apparatus using the electron source.

2. Description of the Related Art

A surface conduction electron-emitting device is based on the phenomenon that a conductive film formed on an insulating substrate is supplied with a current in parallel to a surface of the conductive film, to emit electrons. Fundamentally, a pair of device electrodes are formed on the substrate. The conductive film is formed so as to connect the device electrodes to each other. A minute gap is provided in the conductive film to form a pair of conductive films. An operation called "activation" is performed to deposit a pair of carbon films in the gap and on portions of the conductive films which are close to the gap. The pair of carbon films have a minute gap and each of the carbon films is connected to corresponding one of the conductive films. When a predetermined voltage is applied between the device electrodes in the electron-emitting device, electrons are emitted from the vicinity of the gap between the conductive films and the vicinity of the gap between the carbon films.

Japanese Patent Application Laid-Open No. 2000-251628 discusses a structure in which the carbon films are deposited to extend from the vicinity of the gap between the conductive films to a portion of the substrate which is located outside the vicinity of the gap.

The extending portions of the carbon films are conductive, and accordingly there is an effect that a variation in potential of a surrounding surface of the insulating substrate is reduced. However, a sufficient gap cannot be provided between the extending portions of the pair of carbon films depending on formation conditions, and hence there is a case where end sections (sections apart from the conductive films) of the extending portions are connected to each other.

When the extending portions of the carbon films are connected to each other as described above, an ineffective current (leak current) flows between the device electrodes through the extending portions, and, as a result, there is a case where electron-emitting efficiency reduces. Long time driving or vacuum atmosphere reduction tends to cause discharge break-down. Depending on a material or surface state of the substrate on which the electron-emitting device is placed, the extending portions of the carbon films are likely to vary in shape, which tends to cause variations in electron-emitting characteristics of electron-emitting devices. The electron-emitting efficiency ($\eta$) is estimated as a ratio between a device current If flowing between the pair of device electrodes included in the electron-emitting device and an electron-emitting current Ie (current reaching the anode) and expressed by "$\eta$=Ie/If".

A display using a large number of electron-emitting devices is required to have low power consumption and high luminance and obtain an image with high uniformity. Therefore, the electron-emitting device is required to have high efficiency and stably and uniformly obtain a large electron-emitting amount.

SUMMARY OF THE INVENTION

The present invention has been made in view of the problems described above. An object of the present invention is to provide an electron-emitting device which is excellent in electron-emitting efficiency and capable of obtaining a large electron-emitting amount and stable electron-emitting characteristics. Another object of the present invention is to provide an electron source which uses the electron-emitting device and thus which is excellent in uniformity and stability and obtains a large electron-emitting amount, and an image display apparatus which uses the electron-emitting device and thus which is excellent in display characteristics.

According to a first aspect of the present invention, there is provided an electron emitting-device, comprising: a first conductive film and a second conductive film placed on a substrate having a gap therebetween; a first carbon film having one end and the other end, the one end connected to the first conductive film, and the other end interposed in the gap between the first conductive film and the second conductive film; and a second carbon film having one end and the other end, the one end connected to the second conductive film, and the other end facing the other end of the first carbon film interposing a second gap; wherein the first carbon film and the second carbon film respectively have an extending portion along a Y axis extending from the portion between the first conductive film and the second conductive film, where an X axis is a direction from the first conductive film to the second conductive film, and the Y axis is a direction parallel to the substrate surface and orthogonal to the X axis, and wherein, in the gap between the first carbon film and the second carbon film, the substrate surface has an concave portion extending between end sections of the extending portions of the carbon films.

According to a second aspect of the present invention, there is provided an electron source comprising the multiple electron emitting-devices of the present invention.

According to a third aspect of the present invention, there is provided an image display apparatus comprising the electron source of the present invention, and a light-emitting member that emits light by being subjected to the irradiation of the electron emitted from the electron source.

According to a fourth aspect of the present invention, there is provided a manufacturing method of the electron emitting-device of the present invention, comprising: forming the first conductive film and the second conductive film having the gap therebetween on the substrate including silicon oxide on the surface; forming the first carbon film connected to the first conductive film and the second carbon film connected to the second conductive film, and, at the same time, forming the concave portion in the gap between the first carbon film and the second carbon film by applying a pulse voltage between the first conductive film and the second conductive film under an atmosphere including a carbon-containing gas; and forming the extending portions on the first carbon film and the second carbon film, respectively, by applying a pulse voltage between the first conductive film and the second conductive film under an atmosphere having a higher partial pressure of the carbon-containing gas than the atmosphere.

The manufacturing method of the electron emitting-device of the present invention, further comprising as a preferred aspect, after the forming of the extending portions on the first carbon film and the second carbon film, selectively exposing, into a solution including hydrogen fluoride, the surface of the substrate positioned in the gap between the first carbon film and the second carbon film.

According to the electron-emitting device of the present invention, the carbon films have the excellent gaps even in the extending portions, and hence problems such as the generation of leak current and the discharge break-down of the electron-emitting device which are due to the defective formation of the gaps are prevented. Therefore, the electron-emitting device can stably emit electrons from the gap between the conductive films and the gaps between the carbon films. Thus, a larger electron-emitting amount and more excellent electron-emitting efficiency can be obtained as compared with a conventional electron-emitting device.

The image display apparatus using the electron-emitting device according to the present invention realizes lower power consumption and high luminance and can stably display a high-quality image.

Further features of the present invention become apparent from the following description of exemplary embodiments with reference to the attached drawings.

DESCRIPTION OF THE EMBODIMENTS

Figure 1A:
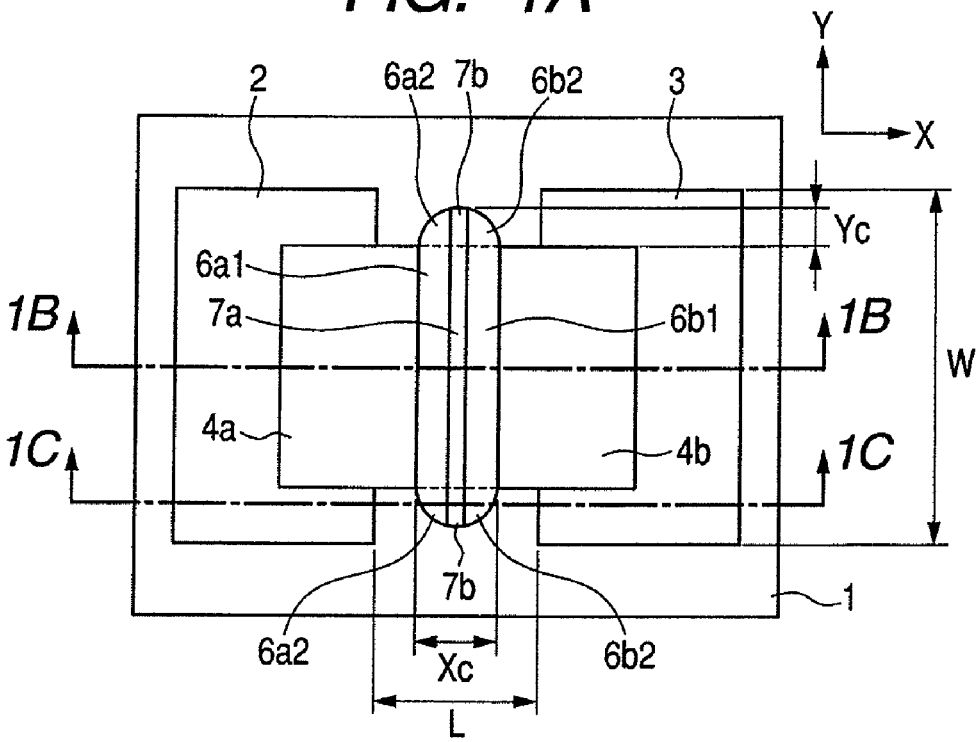
FIGS. 1A, 1B, and 1C are schematic views illustrating an example of an electron-emitting device according to the present invention.

Hereinafter, while referring to the drawings, a detailed description is given to a preferred embodiment of the present invention for an illustrative purpose. Note that the size, material, shape, relative position, etc. of components, which are described in the embodiment, are not intended to limit the scope of the present invention to given examples unless specifically mentioned.

Figure 1B:
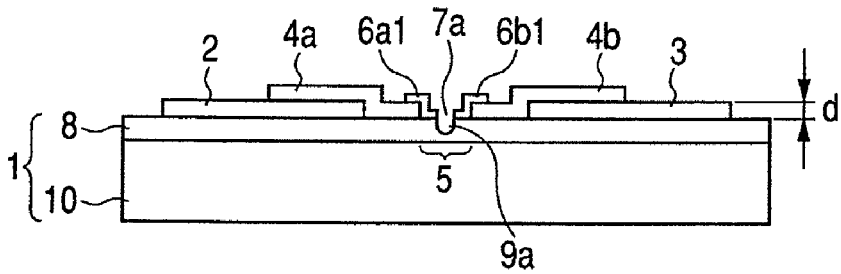
Figure 1C:
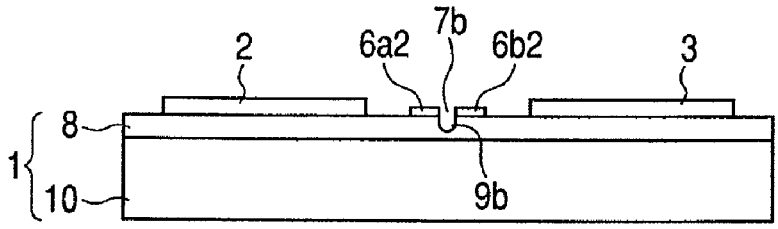

FIGS. 1A to 1C are schematic views illustrating an electron-emitting device according to an embodiment of the present invention. FIG. 1A is a plan view. FIG. 1B is a cross sectional view along a 1B-1B line of FIG. 1A. FIG. 1C is a cross sectional view along a 1C-1C line of FIG. 1A.

FIGS. 1A to 1C illustrates a structure in which a first electrode 2 connected to a first conductive film 4*a* and a second electrode 3 connected to a second conductive film 4*b* are provided on a substrate 1. However, when the first conductive film 4*a* and the second conductive film 4*b* can be connected to a power supply (not shown), the first electrode 2 and the second electrode 3 can be omitted. In the following description, an opposite direction between the first conductive film 4*a* and the second conductive film 4*b* is assumed as an X axis and a direction which is parallel to a surface of the substrate 1 and orthogonal to the X axis is assumed as a Y axis.

The electron-emitting device according to the present invention includes the first conductive film 4*a* and the second conductive film 4*b* which are provided on the substrate 1 and opposed to each other through a first gap 5. One end of the first conductive film 4*a* is connected to the first electrode 2. One end of the second conductive film 4*b* is connected to the second electrode 3. The first gap 5 is provided between the other end of the first conductive film 4*a* and the other end of the second conductive film 4*b*, and the other end of the first conductive film 4*a* and the other end of the second conductive film 4*b* are opposed to each other through the first gap 5 (FIG. 1B).

A first carbon film 6*a*1 is connected to the first conductive film 4*a*. A second carbon film 6*b*1 is connected to the second conductive film 4*b*. One end of the first carbon film 6*a*1 covers at least a portion of the first conductive film 4*a* in the X axis. One end of the second carbon film 6*b*1 covers at least a portion of the second conductive film 4*b* in the X axis. The other end of the first carbon film 6*a*1 and the other end of the second carbon film 6*b*1 are opposed to each other through a second gap 7*a* (FIG. 1B). Note that the first carbon film 6*a*1 and the second carbon film 6*b*1 are conductive.

The second gap 7*a* is located between the first conductive film 4*a* and the second conductive film 4*b* (within first gap 5). The surface of the substrate 1 has a first concave portion 9*a* provided in the second gap 7*a* (directly below second gap 7*a*) along the second gap 7*a*.

The first carbon film 6*a*1 is provided with first extending portions 6*a*2 outwardly extending from a region in which the first conductive film 4*a* and the second conductive film 4*b* are opposed to each other in the Y axis. The second carbon film 6*b*1 is provided with second extending portions 6*b*2 outwardly extending from the region in the Y axis. The first extending portions 6*a*2 are provided on both sides of the first carbon film 6*a*1 so as to sandwich the first carbon film 6*a*1. Similarly, the second extending portions 6*b*2 are provided on both sides of the second carbon film 6*b*1 so as to sandwich the second carbon film 6*b*1.

The first extending portions 6*a*2 are opposed to the second extending portions 6*b*2 with a third gap 7*b* therebetween (FIG. 1C).

The first extending portions 6*a*2 and the second extending portions 6*b*2 are conductive carbon films directly provided on the surface of the substrate 1 (provided on surface of substrate 1 without through first conductive film 4*a* and second conductive film 4*b*). The first extending portions 6*a*2 and the second extending portions 6*b*2 are located outside a region surrounded by the first conductive film 4*a* and the second conductive film 4*b* (that is, region defined by first gap 5). The first carbon film 6*a*1 and the first extending portions 6*a*2 are continuously provided. The second carbon film 6*b*1 and the second extending portions 6*b*2 are continuously provided. The third gap 7*b* and the second gap 7*a* are continuously provided.

For the sake of convenience, the first and second carbon films 6*a*1 and 6*b*1 are described separately from the first and second extending portions 6*a*2 and 6*b*2. However, as described above, the first and second extending portions 6*a*2 and 6*b*2 are made of carbon, and accordingly there is no clear boundary between the first and second carbon films 6a1 and 6b1 and the first and second extending portions 6a2 and 6b2. Therefore, the first and second extending portions 6a2 and 6b2 can be assumed as portions of the first and second carbon films 6a1 and 6b1. For the sake of convenience, the third gap 7b and the second gap 7a are also separately described. However, the third gap 7b and the second gap 7a are also continuously provided, and accordingly the third gap 7b can be assumed as a portion of the second gap 7a.

Thus, in the following description, the first and second carbon films 6a1 and 6b1 in the region in which the first conductive film 4a and the second conductive film 4b are opposed to each other are referred to as facing portions of the carbon films. The opposed portion 6a1 and the two extending portions 6a2 sandwiching the opposed portion 6a1 are collectively referred to as a carbon film 6a. The opposed portion 6b1 and the two extending portions 6b2 sandwiching the opposed portion 6b1 are collectively referred to as a carbon film 6b.

The greatest feature of the electron-emitting device according to the present invention is that the surface of the substrate 1 has a second concave portion 9b not only directly below the second gap 7a (within second gap 7a) but also directly below the third gap 7b (within third gap 7b) (FIGS. 1B and 1C). That is, the surface of the substrate 1 has a single continuous (communicating) concave portion (9a and 9b) directly below the second and third gaps 7a and 7b (within second and third gaps 7a and 7b) for separating the pair of carbon films 6a and 6b including the first and second extending portions.

When the second concave portion 9b is provided as described above, electrons can be stably emitted from not only the second gap 7a but also the third gap 7b. A leak current generated between the first and second extending portions 6a2 and 6b2 can be reduced. As a result, it is possible to obtain an electron-emitting device having high electron-emitting efficiency, a large electron-emitting amount, and stable electron-emitting characteristics.

Glass (such as quartz glass, glass having reduced content of impurity such as Na, or soda lime glass), ceramic such as alumina, and silicon can be used for the substrate 1. Such a material is desirably used as a base material 10 and a passivation layer 8 is desirably provided on a surface of the base material 10 to produce the substrate 1. The passivation layer 8 is a sufficient-high-resistance layer serving as an insulator, and thus can be referred to an insulating layer.

A material of the passivation layer 8 is desirably an insulating material (sufficient-high-resistance material) which has a high heat resistance (desirably exceeding 1,000K) and suppresses the diffusion of Na ions to the first and second conductive films 4a and 4b sides. Specifically, in order to obtain excellent electron-emitting characteristics by an activation operation described later, a silicon oxide layer (typically, $SiO_2$ layer) is desirably used. However, the material of the passivation layer 8 desirably satisfies the requirement described above, and thus is not limited to silicon oxide.

The passivation layer 8 desirably covers the entire surface of the base material 10 in a simple manner. The passivation layer 8 can also be provided only between a region of the electron-emitting device (first and second conductive films 4a and 4b, first and second carbon films 6a and 6b, and second and third gaps 7a and 7b) and the base material 10. The passivation layer 8 is desirably provided in at least a region between a group including the third gap 7b and the first and second extending portions 6a2 and 6b2 and a group including the base material 10.

The passivation layer 8 desirably has a sufficient thickness (equal to or larger than 100 nm and equal to or smaller than 1 μm in practical use) equal to or larger than a depth of the concave portion 9b formed directly below the second gap 7a (within second gap 7a). It is necessary to provide the passivation layer 8 with a sufficient length (equal to or larger than 10 μm and equal to or smaller than 100 μm in practical use) from both end portions of the first and second conductive films 4a and 4b in the Y axis.

The first and second electrodes 2 and 3 can be made of a normal conductor material. For example, the conductor material is selected as appropriate from metal such as Ni, Cr, Au, Mo, W, Pt, Ti, Al, Cu, or Pd or an alloy thereof, but is not limited thereto. An interval (electrode interval) L between the first electrode 2 and the second electrode 3, an electrode length W, and a shape of the first and second conductive films 4a and 4b are designed as appropriate in view of applied patterns. The electrode interval L can be practically set in a range of 1 μm to 100 μm, more desirably, in a range of 5 μm to 10 μm. The electrode length W can be set in a range of 1 μm to 500 μm in view of an electrode resistance value and electron-emitting characteristics. A film thickness d of the first and second electrodes 2 and 3 is set in a range of 10 nm to 5 μm.

A material of the first and second conductive films 4a and 4b is selected from: metal such as Pd, Pt, Ru, Ag, Au, Ti, In, Cu, Cr, Ni, Fe, Zn, Sn, Ta, W, or Pb; and an alloy containing those metal, for example. However, the material is not limited thereto. Taking into consideration that "energization forming operation" process described later is carried out in order to obtain satisfactory electron-emitting characteristics, in practice, it is desirable that a resistance value Rs of the conductive film 4 be in the range of from $10^2\Omega/\square$ to $10^7\Omega/\square$. It is to be noted that Rs is a value expressed as R=Rs(l/w) where R is resistance in the length direction of a film having the width w and the length l.

There are various methods of manufacturing the electron-emitting device according to the present invention as described above. An example of the manufacturing method is described below with reference to FIGS. 2A to 2E.

(Step-1)

Figure 2A:
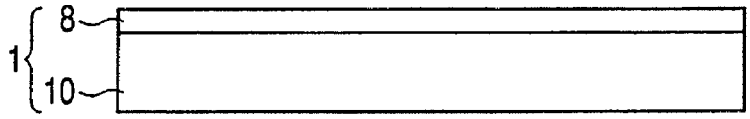
FIGS. 2A, 2B, 2C, 2D, and 2E are explanatory views illustrating a method of manufacturing the electron-emitting device according to the present invention.

The base material 10 is cleaned with a cleaning solution, deionized water, and an organic solvent. Then, the passivation layer 8 containing silicon oxide as a main ingredient is laminated on the base material 10 by various known film formation processes such as a sputtering process, a sol gel application process, and a CVD process, to prepare the substrate 1 (FIG. 2A).

The passivation layer 8 may be formed into a predetermined shape by patterning on the substrate 10. When a material which does not substantially contain an alkali component, such as quartz or non-alkali glass, is used as the base material 10, the passivation layer 8 may not be necessarily provided.

(Step-2)

Figure 2B:
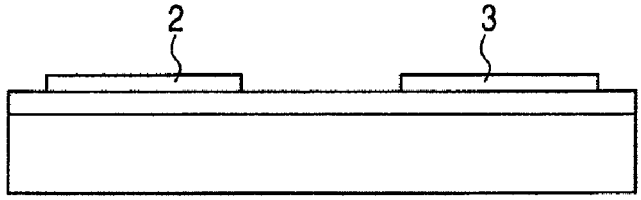

A material of the first and second electrodes 2 and 3 is deposited on the substrate 1 by a known film formation process such as a vacuum evaporation process or a sputtering process. After that, the first electrode 2 and the second electrode 3 are formed on the substrate 1 by, for example, a photolithography technique (FIG. 2B).

(Step-3)

Figure 2C:
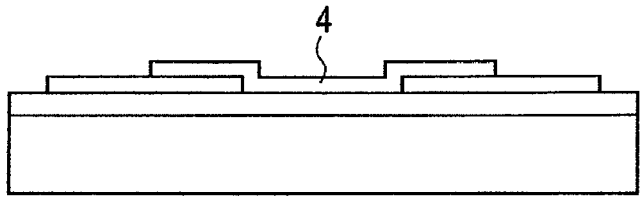

A conductive film 4 for connecting the first electrode 2 and the second electrode 3 to each other is formed on the substrate 1 on which the first and second electrodes 2 and 3 are provided (FIG. 2C). Examples of a process of forming the conductive film 4 include a sputtering process, a vacuum evaporation process, a CVD process, and a spinner process. However, the process of forming the conductive film 4 is not limited to the processes. For example, an application process employing an ink-jet system can be also used.

(Step-4)

Then, the first gap 5 is formed in the conductive film 4. An example of an operation called an "energization forming operation" is described below.

Figure 2D:
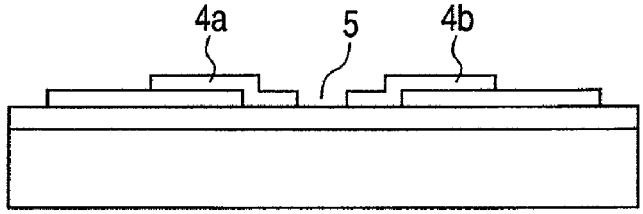

Specifically, when a voltage is applied between the first and second electrodes 2 and 3, the first gap 5 can be provided in a portion of the conductive film 4. In other words, as a result, the first and second conductive films 4*a* and 4*b* separated from each other by the first gap 5 can be formed as a pair (FIG. 2D).

Figure 3A:
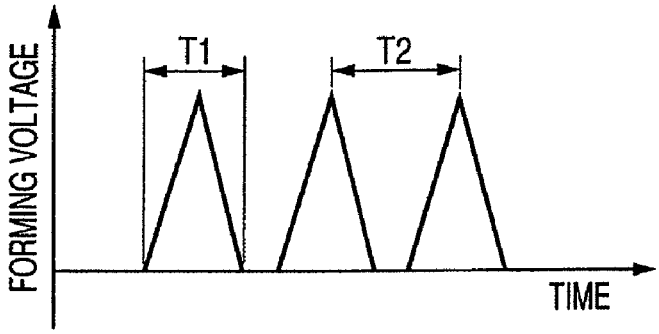
FIGS. 3A and 3B are schematic diagrams illustrating examples of a forming voltage waveform used to manufacture the electron-emitting device according to the present invention.
Figure 3B:
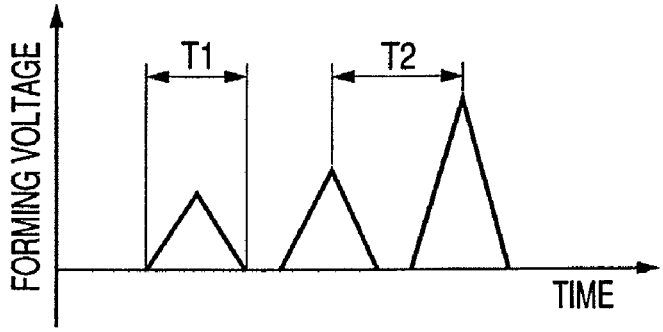

FIGS. 3A and 3B illustrate examples of a voltage waveform used for an energization forming operation. The voltage waveform is desirably a pulse voltage waveform. A method illustrated in FIG. 3A is a method of repeatedly applying a pulse voltage whose pulse peak is constant. A method illustrated in FIG. 3B is a method of repeatedly applying a pulse voltage while a pulse peak is increased. In FIGS. 3A and 3B, T1 denotes a pulse width and T2 denotes a pulse interval. The pulse waveform is not limited to a triangle wave and a desirable waveform such as a square wave can be employed.

As described above, the first and second conductive films 4*a* and 4*b* separated from each other by the first gap 5 are formed as a pair by the energization forming operation. Even in a case of a known method which does not include energization, such as electron-beam (EB) lithography, the first and second conductive films 4*a* and 4*b* separated from each other by the first gap 5 can be provided as a pair on the substrate 1. Therefore, Steps 3 and 4 can be collectively referred to as a step of providing the first and second conductive films 4*a* and 4*b* as a pair on the substrate 1.

Figure 4:
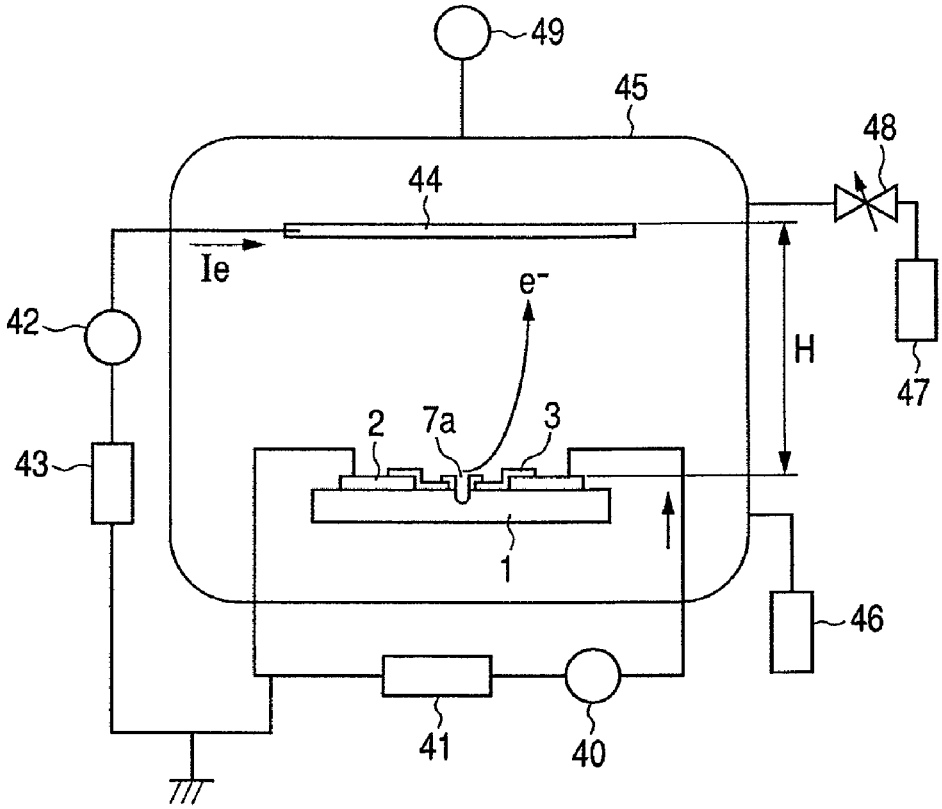
FIG. 4 is a schematic diagram illustrating an example of a vacuum processing apparatus used to manufacture the electron-emitting device according to the present invention.

The energization forming operation and subsequent electrical operations can be performed in, for example, a vacuum processing apparatus as illustrated in FIG. 4. The vacuum processing apparatus also serves as a measurement evaluation apparatus.

In FIG. 4, a vacuum container 45 and an exhaust pump 46 are provided in the vacuum processing apparatus. The substrate 1 obtained through Steps 1 to 4 described above is placed in the vacuum container 45. A power supply 41 for applying a voltage Vf to the electron-emitting device and a current meter 40 for measuring a device current If flowing between the first electrode 2 and the second electrode 3 are also provided. An anode electrode 44 for capturing an emitting current Ie emitted from the electron-emitting device is located over the electron-emitting device. A high-voltage supply 43 for applying a voltage to the anode electrode 44 and a current meter 42 for measuring the emitting current Ie are also provided. For example, the measurement can be performed in a case where the voltage applied to the anode electrode 44 is set in a range of 1 kV to 15 kV and a distance H between the anode electrode 44 and the substrate 1 is set in a range of 0.5 mm to 8 mm. The vacuum container 45 is provided with a vacuum gauge 49. The vacuum container 45 is connected through a valve 48 to a carbon compound source 47 used for the activation operation described later. The entire vacuum processing apparatus including the substrate 1 can be heated by a heater (not shown).

(Step-5)

Figure 2E:
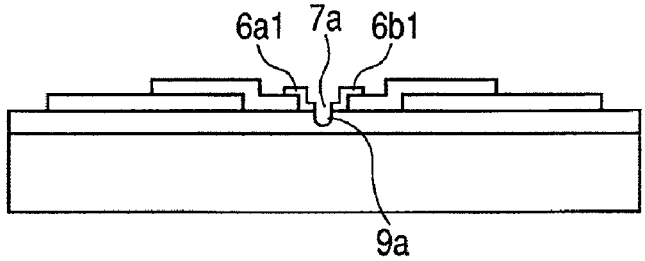

Next, the facing portions 6*a*1 and 6*b*1 of the pair of carbon films which are separated from each other by the second gap 7*a* are provided on the first and second conductive films 4*a* and 4*b* and a surface of the substrate 1 which is located in the first gap 5 (FIG. 2E).

The facing portions 6*a*1 and 6*b*1 of the carbon films can be formed by, for example, a known activation operation. Specifically, when a pulse voltage is applied between the first conductive film 4*a* and the second conductive film 4*b* under an atmosphere including a carbon-containing gas, the carbon films can be deposited on the first and second conductive films 4*a* and 4*b* and in the first gap 5.

As the carbon-containing gas, for example, an organic substance gas can be used. As the organic substance, it is possible to provide aliphatic hydrocarbon such as alkane, alkene, or alkyne, aromatic hydrocarbon, alcohol, aldehyde, ketone, amine, organic acid such as phenol, carboxylic acid, or sulfonic acid. More specifically, it is possible to use saturated hydrocarbon expressed by $C_nH_{2n+2}$, such as methane, ethane, or propane, unsaturated hydrocarbon expressed by a composition formula of $C_nH_{2n}$ or the like, such as ethylene or propylene. It is also possible to use benzene, toluene, methanol, ethanol, formaldehyde, acetaldehyde, acetone, methyl ethyl ketone, methylamine, ethylamine, phenol, formic acid, acetic acid, propionic acid, or the like. In particular, tolunitrile is preferably used.

Figure 5A:
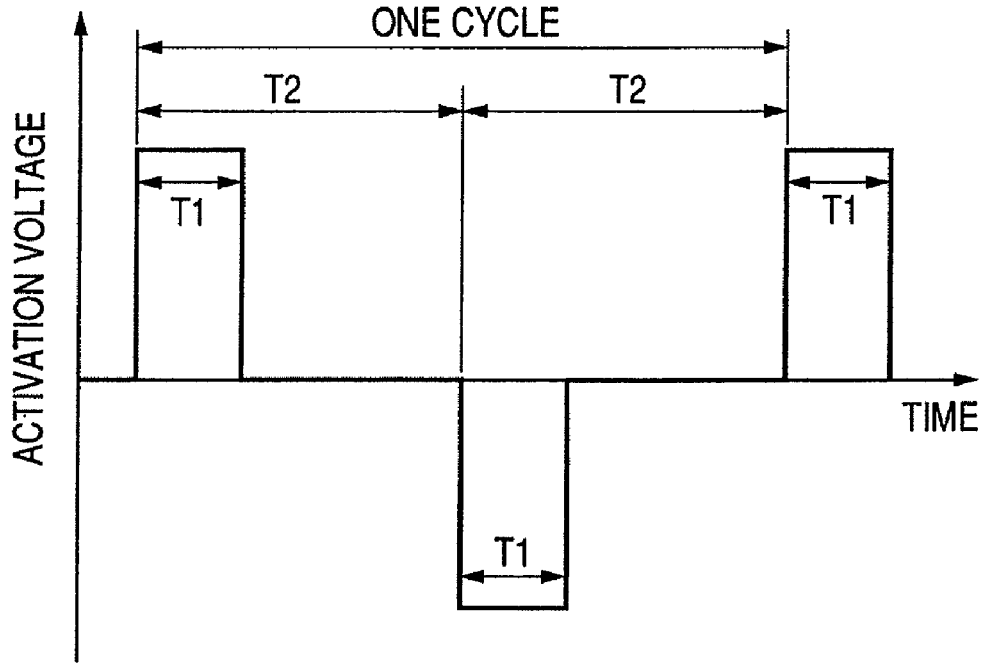
FIGS. 5A and 5B are schematic diagrams illustrating examples of a voltage waveform in an activation operation used to manufacture the electron-emitting device according to the present invention.
Figure 5B:
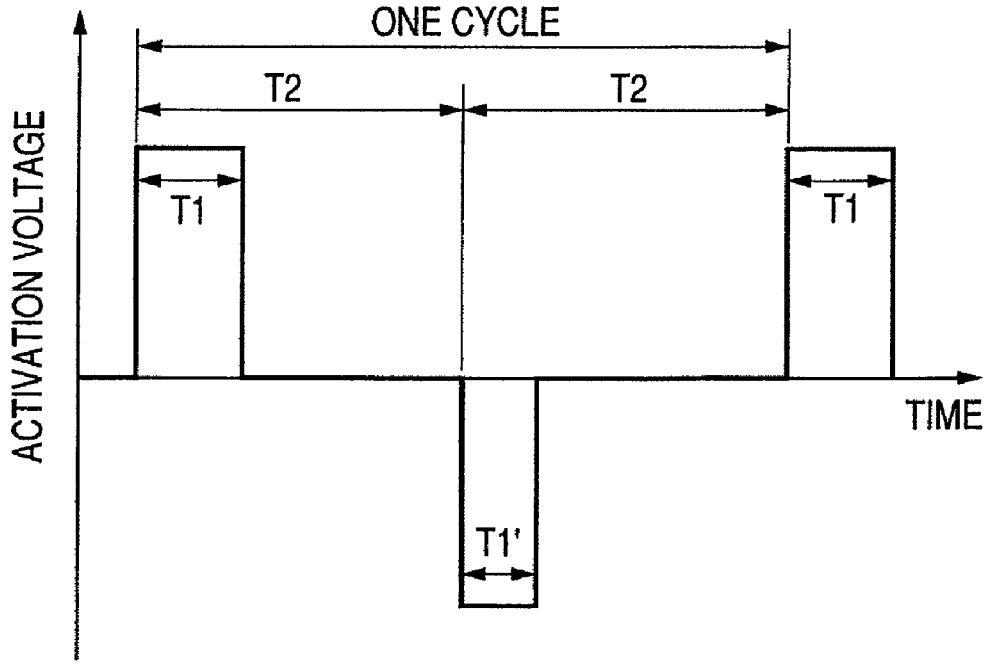

FIGS. 5A and 5B illustrates examples of a voltage waveform used in the activation step. In FIG. 5A, T1 denotes a width of positive and negative pulses of the voltage waveform and T2 denotes a pulse interval. A pulse voltage value is set such that absolute values of positive and negative voltages are equal to each other. In FIG. 5B, T1 and T1' denote widths of positive and negative pulses of the voltage waveform and T2 denotes a pulse interval. A relationship of T1>T1' is satisfied. A pulse voltage value is set such that absolute values of positive and negative voltages are equal to each other.

When the surface of the substrate 1 which is located in the second gap 7*a* contains silicon oxide, the first concave portion 9*a* can be formed in the surface of the substrate 1 by the activation operation (FIG. 2E). The reason why the first concave portion 9*a* is formed may be that carbon contained in the gas used for the activation operation or carbon deposited on the substrate reacts with silicon oxide contained in the substrate 1. A primary reaction may be $SiO_2+C \rightarrow SiO\uparrow+CO\uparrow$. During the activation operation, a current flows between the first conductive film 4*a* and the second conductive film 4*b* (heat energy is applied), and therefore the reaction may be promoted. The formed first concave portion 9*a* significantly influences the electron-emitting characteristics.

Note that the facing portions 6*a*1 and 6*b*1 of the carbon films can be formed by selectively irradiating a predetermined region on the substrate 1 with an electron beam in the carbon-containing gas. Therefore, the method of forming the facing portions 6*a*1 and 6*b*1 of the pair of the carbon films which are separated from each other by the second gap 7*a* is not limited to the activation operation.

(Step-6)

Next, the first and second extending portions 6*a*2 and 6*b*2 of the carbon films are provided. In order to provide the first and second extending portions 6*a*2 and 6*b*2, for example, after the activation operation is completed, a pulse voltage is repeatedly applied under an atmosphere in which a carbon-containing gas partial pressure is higher than the carbon-containing gas partial pressure for the activation operation. The first and second extending portions 6*a*2 and 6*b*2 can be provided by selectively irradiating, with an electron beam, a predetermined region in which the first and second extending portions 6*a*2 and 6*b*2 are to be provided, under the atmosphere including the carbon-containing gas.

Steps 5 and 6 are separately set. However, Steps 5 and 6 can be successively performed. In such a case, Steps 5 and 6 can be assumed as a single step.

(Step-7)

Next, the first and second concave portions 9*a* and 9*b* each having a sufficient width and depth are formed in a surface portion of the substrate 1 which is located in the second gap 7*a* (directly below second gap 7*a*) and in a surface portion of the substrate 1 which is located in the third gap 7*b* (directly below third gap 7*b*).

When the first concave portion 9*a* is previously provided by the activation operation in Step-5, at least the second concave portion 9*b* may be desirably formed in Step-7. When the first concave portion 9*a* previously provided in Step-5 does not have an insufficient size, the size of the first concave portion 9*a* can be increased in Step-7.

When the third gap 7*b* is not sufficiently formed in Step-6 and thus the first extending portions 6*a*2 are connected to the second extending portions 6*b*2 in the extending portions (particularly, end sections of extending portions), the degree of electrical connection between the extending portions can be reduced in Step-7. Typically, the third gap 7*b* is extended to the end sections of the extending portions or a width of the third gap 7*b* in the extending portions is widened.

According to Step-7, for example, when the surface portion of the substrate 1 which is located in the second gap 7*a* and the surface portion of the substrate 1 which is located in the third gap 7*b* are selectively exposed to an aqueous solution containing hydrogen fluoride, the first and second concave portions 9*a* and 9*b* can be formed by etching.

With respect to the structures of the first and second concave portions 9*a* and 9*b*, a practical depth is desirably equal to or larger than 30 nm and equal to or smaller than 100 nm and a practical width is desirably equal to or larger than 5 nm and equal to or smaller than 20 nm. For example, a practical concentration of the aqueous solution containing hydrogen fluoride, which is used in Step-7 is desirably equal to or larger than 0.1 weight % and equal to or smaller than 10 weight %. When the first and second concave portions 9*a* and 9*b* are formed, however, the concentration is not limited to the range described above. The aqueous solution containing hydrogen fluoride includes a buffer solution containing hydrogen fluoride. In order to easily form the first and second concave portions 9*a* and 9*b* by such wet etching, a porous silica film (not shown) is desirably formed in advance on a portion of the passivation layer 8 which is located directly under a region in which at least the third gap 7*b* is to be formed. In Step-7, the wet etching using hydrogen fluoride is used as an example of etching. However, various etching methods including dry etching can be used as appropriate.

According to Step-7, the first and second concave portions 9*a* and 9*b* each having a predetermined width and depth can be formed by control. As a result, electrons can be stably emitted from the first and second extending portions 6*a*2 and 6*b*2. A current component leaked through the first extending portions 6*a*2 and the second extending portions 6*b*2 can be reduced, and accordingly an increase in electron-emitting amount, stable electron emission, and the improvement of electron-emitting efficiency can be achieved. The shapes of the first and second concave portions 9*a* and 9*b* can be controlled, and accordingly the uniformity of electron-emitting characteristics can be improved in a case where multiple electron-emitting devices are formed.

(Step-8)

The electron-emitting device obtained through Steps 1 to 7 described above is desirably subjected to a stabilization step.

Step-8 is a step of removing unnecessary organic substances from the electron-emitting device or a surface portion of the substrate 1 which is located close to the electron-emitting device under an atmosphere with a high degree of vacuum (degree of vacuum higher than degree of vacuum during activation process in case where activation process is performed). With respect to the degree of vacuum, an organic substance partial pressure is desirably equal to or smaller than $10^{-6}$ Pa, and more desirably equal to or smaller than $10^{-8}$ Pa. A total pressure is desirably minimized. A practical total pressure is desirably equal to or smaller than $10^{-5}$ Pa, and more desirably equal to or smaller than $10^{-6}$ Pa.

The electron-emitting device according to the present invention can be formed through the steps described above.

An atmosphere during the operation of the electron-emitting device according to the present invention is desirably maintained to the atmosphere when the stabilization step is completed. However, when organic substances are sufficiently removed, sufficiently stable characteristics can be maintained even in a case of a slight increase in pressure. When such a vacuum atmosphere is employed, carbon or a carbon compound can be suppressed from being newly deposited on the electron-emitting device or the surface portion of the substrate 1 which is located close to the electron-emitting device. As a result, the device current If and the emitting current Ie stabilize.

Next, examples in which multiple electron-emitting devices each of which is the electron-emitting device according to the present invention are arranged on a substrate to produce an electron source and an image display apparatus are described.

Various arrangements of the electron-emitting devices can be employed. A matrix arrangement schematically illustrated in FIG. 6 can be employed as an example. In this example, multiple (m×n) electron-emitting devices 54 are arranged in matrix in the X axis and the Y axis. One of the first and second electrodes 2 and 3 of each of multiple electron-emitting devices 54 arranged in the same row is commonly connected to a wiring (Dx1; . . . ; Dxm) in the X axis. The other of the first and second electrodes 2 and 3 of each of multiple electron-emitting devices arranged in the same row is commonly connected to a wiring (Dy1; . . . ; Dym) in the Y axis. An electron source having the matrix arrangement is described below with reference to FIG. 6.

Figure 6:
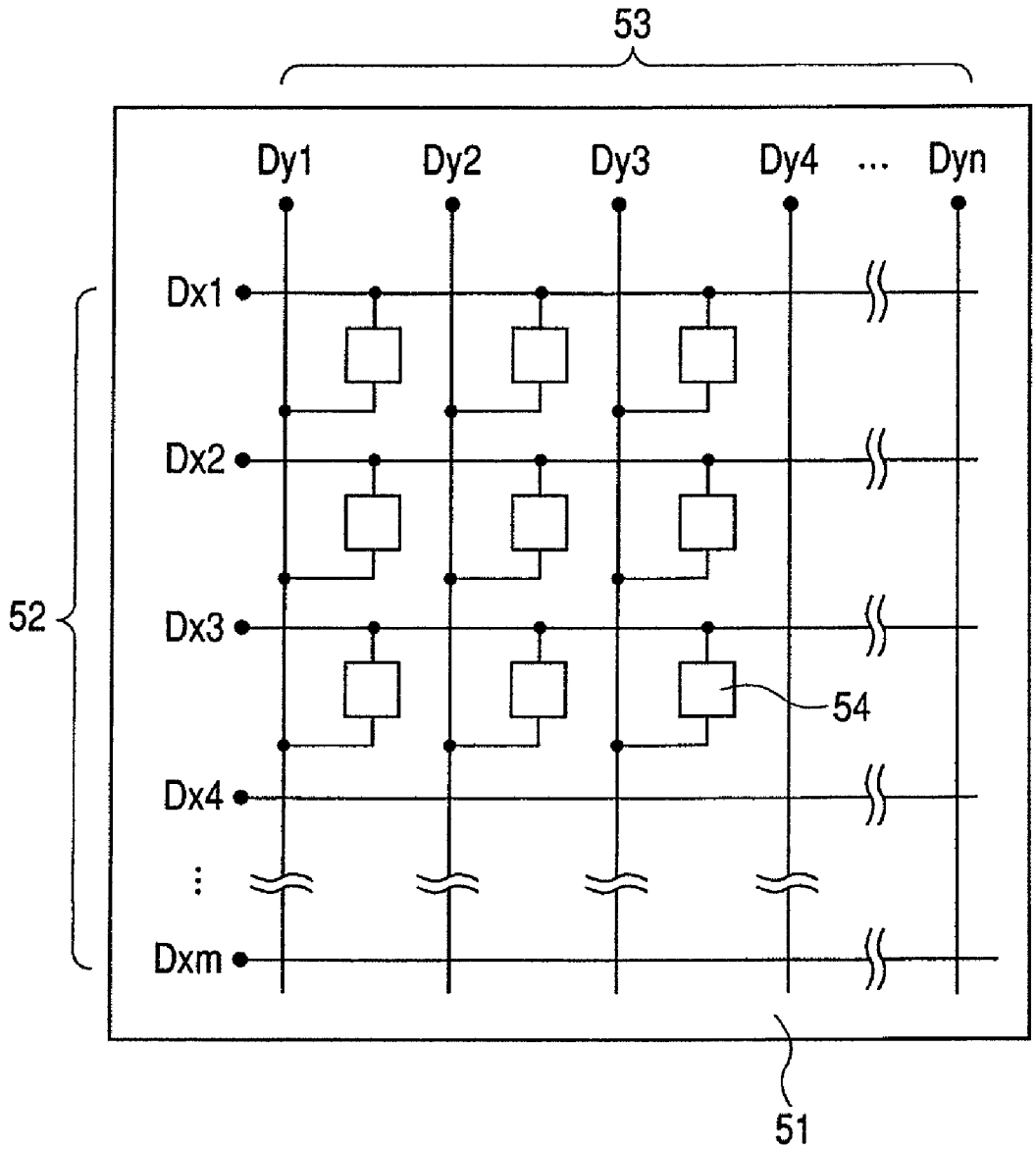
FIG. 6 is a schematic diagram illustrating an example of an electron source according to the present invention.

In FIG. 6, the electron source includes an electron source substrate 51, X-axis wirings 52, Y-axis wirings 53, and the electron-emitting devices 54.

The X axis wirings 52 include m wirings Dx1, Dx2, . . . , and Dxm, and are each formed of a conductive metal etc. formed through a vacuum evaporation process, a printing process, a sputtering process, or the like. The material, thickness, and width of the wirings may be appropriately designed. The Y axis wirings 53 include n wirings Dy1, Dy2, . . . , and Dyn, and are each formed similarly to the X axis wirings 52. Interlayer insulating layers (not shown) are provided between those m X axis wirings 52 and the n Y axis wirings 53 to electrically separate the wirings from each other (m and n each indicate a positive integer).

The interlayer insulating layer (not shown) is made of $SiO_2$ etc. formed through a vacuum evaporation process, a printing process, a sputtering process, or the like, insulating metal oxide, or a mixture thereof. For example, the interlayer insulating layer is formed into a desired shape on the entire surface or a part of the electron source substrate 51 in which the X-axis wirings 52 are formed. In particular, a film thickness, a material, and a manufacturing method of the interlayer insulating film are set as appropriate so as to be able to withstand potential differences at intersections of the X-axis wirings 52 and the Y-axis wirings 53. The X-axis wirings 52 and the Y-axis wirings 53 are led out as external terminals.

The first and second electrodes 2 and 3 included in the electron-emitting devices 54 are electrically connected to the m X-axis wirings 52 and the n Y-axis wirings 53.

The X-axis wirings 52, the Y-axis wirings 53, and the first and second electrodes 2 and 3 are made of materials whose constituting elements may be completely the same, partially the same, or different from each other. Those materials are appropriately selected from, for example, the above-mentioned electrode materials. When the material of the electrodes is the same as that of the wiring, the wiring connected to the electrode can be also regarded as the electrode.

A scanning signal application unit (not shown) for applying a scanning signal for selecting one of rows arranged in the X axis of the electron-emitting device 54 is connected to the X axis wirings 52. On the other hand, a modulation signal generation unit (not shown) for modulating the columns arranged in the Y axis of the electron-emitting device 54 in accordance with the input signal is connected to the Y axis wirings 53. A drive voltage to be applied to the respective electron-emitting devices is supplied in the form of a difference voltage between the scanning signal and the modulation signal applied to the respective electron-emitting device.

According to the above-mentioned structure, the electron-emitting devices are individually selected, thus allowing the devices to be individually driven by using simple matrix wirings.

Figure 7:
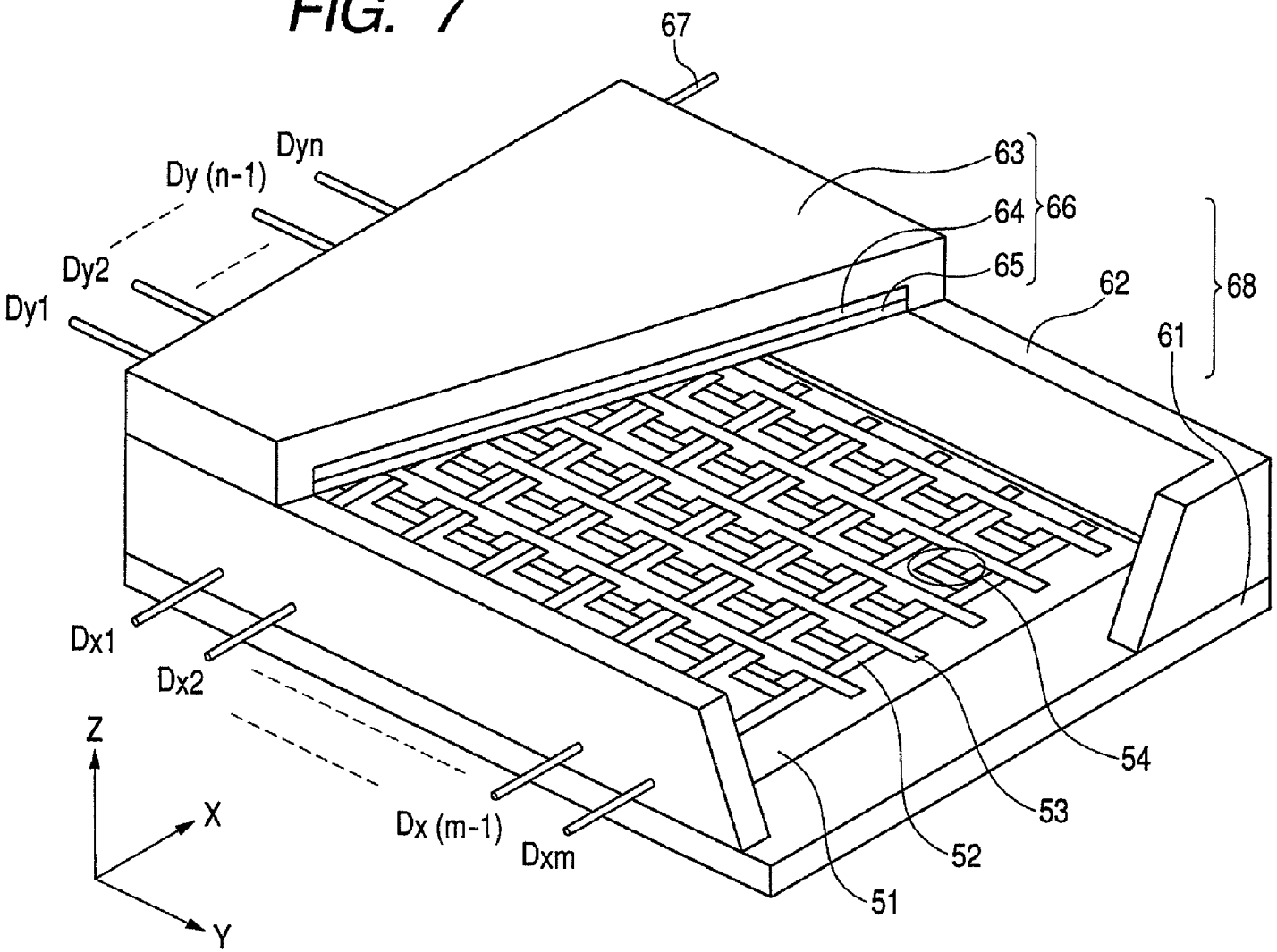
FIG. 7 is a schematic view illustrating an example of a display panel of an image forming apparatus according to the present invention.
Figure 8A:
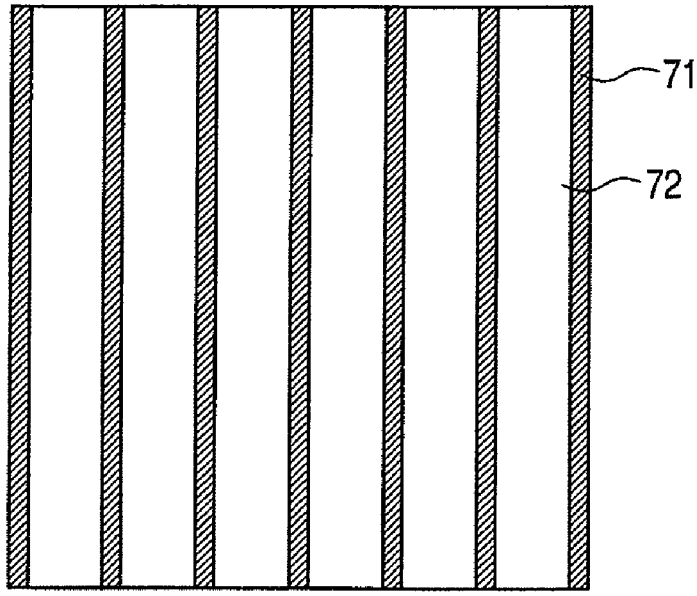
FIGS. 8A and 8B are schematic views illustrating examples of a fluorescent film in the display panel.
Figure 8B:
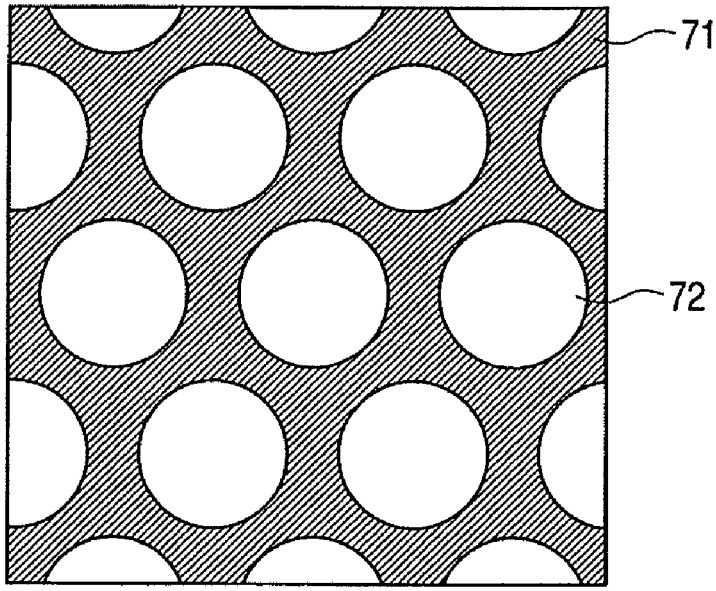

While referring to FIGS. 7, 8A, and 8B, the image forming apparatus arranged by using the electron source having the above-mentioned simple matrix arrangement is described. FIG. 7 is a schematic diagram of an example of a display panel for the image display device. FIGS. 8A and 8B are schematic views of a fluorescent film as a light-emitting member used for the image forming apparatus of FIG. 7.

FIG. 7 illustrates the electron source substrate 51 having the plurality of electron-emitting devices illustrated in FIG. 6 arranged thereon, a rear plate 61 fixing the electron source substrate 51 thereto, and a face plate 66 in which a fluorescent film 64 as a light-emitting member provided on an inner surface of a glass substrate 63 and a metal back 65 are formed. FIG. 7 also illustrates a supporting frame 62 and an enclosure 68. Connected to the supporting frame 62 are the rear plate 61 and the face plate 66 by using an adhesive or the like.

The electron-emitting devices 54 each of which is the electron-emitting device illustrated in FIGS. 1A to 1C are provided. The X-axis wirings 52 and the Y-axis wirings 53 as illustrated in FIG. 6 are connected to the device (first and second) electrodes 2 and 3 of the surface conduction electron-emitting devices.

As described above, the enclosure 68 is structured by the face plate 66, the supporting frame 62, and the rear plate 61. The rear plate 61 is provided for a purpose of enhancing the strength of the electron source substrate 51 mainly, and hence when the electron source substrate 51 itself has a sufficient strength, it is unnecessary to separately provide the rear plate 61. In other words, the enclosure 68 may be structured by bonding the supporting frame 62 directly to the electron source substrate 51 and only using the face plate 66, the supporting frame 62, and the electron source substrate 51.

FIGS. 8A and 8B are schematic views illustrating examples of the fluorescent film. A color fluorescent film can include a black member 71 called a black stripe (FIG. 8A) or a black matrix (FIG. 8B) and a phosphor 72 in view of phosphor arrangement. The metal back 65 is normally provided on an inner surface side of a fluorescent film 64.

The image forming apparatus according to the present invention described above may be employed as an image forming apparatus for a photo printer arranged by using a photosensitive drum and the like, in addition to a television broadcasting display device, display devices for a television conference system, a computer, and so forth.

EXAMPLE

Hereinafter, specific examples of the present invention are described. The present invention is not limited to the examples and thus includes cases where element exchanges and modifications in design are made within the scope within which the object of the present invention can be achieved.

Example 1

The electron-emitting device illustrated in FIGS. 1A to 1C was manufactured through the steps illustrated in FIGS. 2A to 2E.

(Step-a)

The glass base material 10 (produced by Asahi Glass Co. Ltd., PD200) was sufficiently cleaned with a cleaning solution, deionized water, and an organic solvent. Then, the passivation layer 8 made of $SiO_2$ was deposited on the base material 10 at a thickness of approximately 250 nm using an Rf sputtering apparatus, to prepare the substrate 1 (FIG. 2A).

(Step-b)

A Ti layer having a thickness of 5 nm and a Pt layer having a thickness of 40 nm were successively deposited on the substrate 1 by a sputtering process. Then, an etching mask (photoresist) was formed so as to cover a pattern of the first and second electrodes 2 and 3. Next, dry etching using Ar plasma was performed and subsequently a remaining portion of the etching mask was removed by dissolving to form the first and second electrodes 2 and 3 (FIG. 2B). The interval L between the first and second electrodes 2 and 3 was set to 30 μm and the width W thereof was set to 300 μm.

(Step-c)

A mask having an aperture portion, corresponding to a pattern of the conductive film 4 for connecting the first and second electrodes 2 and 3 to each other was formed. Next, a Pd film having a thickness of 10 nm was deposited by a sputtering process. The mask was dissolved using an organic solvent to lift off an unnecessary portion of the Pd film, thereby forming the conductive film 4 made of Pd (FIG. 2C). A width of the conductive film 4 in the Y axis is 100 μm.

(Step-d)

The substrate 1 provided with the conductive film 4 was placed in the vacuum container 45 illustrated in FIG. 4. The vacuum container 45 was evacuated by the exhaust pump 46. After the degree of vacuum reached $2.7\times10^{-6}$ Pa, a voltage from the power supply 41 for applying the device voltage Vf was applied between the first and second electrodes 2 and 3 to perform an energization forming operation. A voltage waveform for the energization forming operation was a square wave. A peak was gradually increased in the same manner as illustrated in FIG. 3B.

In this example, the pulse width T1 was set to 1 msec., the pulse interval T2 was set to 10 msec., and the peak of the square wave was gradually increased from 0 V in steps of 0.1 V. During the energization forming operation, a resistance measurement pulse having a peak of 0.1 V was inserted between adjacent pulses to measure a current, thereby detecting a resistance. When the resistance exceeded 1 MΩ, the energization forming operation was completed.

(Step-e)

Subsequently, the vacuum container 45 was further evacuated by the exhaust device. After the pressure became equal to or smaller than $5\times10^{-6}$ Pa, the valve 48 connected to the carbon compound (material) source 47 containing tolunitrile was opened to introduce a tolunitrile gas into the vacuum container 45. The pressure was $1.0\times10^{-4}$ Pa.

Next, as illustrated in FIG. 5A, the square wave pulse which has the predetermined peak and pulse width and the alternately reversed polarity was repeatedly applied between the first and second electrodes 2 and 3. The peak was set to ±16 V, the pulse width T1 was set to 1 msec., and the pulse interval T2 was set to 10 msec.

When the square wave pulse was being applied in the presence of tolunitrile, the value of If increased. After a lapse of approximately 50 minutes, the increase in value of If was slow and the value of If substantially saturated. The application of the pulse voltage was further continued for 10 minutes, and then stopped. The vacuum container 45 was evacuated. Then, the activation operation was completed. In this step, the first and second carbon films 6*a*1 and 6*b*1 were deposited, the second gap 7*a* was formed, and the first concave portion 9*a* was formed.

(Step-f)

Subsequently, tolunitrile was introduced into the vacuum container 45 again at a pressure ($2.7\times10^{-3}$ Pa) higher than the pressure in Step-e. Then, a pulse voltage was applied between the first and second electrodes 2 and 3 for 20 minutes. An applied waveform and peak of the pulse voltage are the same as in Step-e.

After the procedure described above, the electron-emitting device was observed using an optical microscope. As a result, it was determined that the electron-emitting device having the structure schematically illustrated in FIG. 1A was obtained. In the first and second extending portions 6*a*2 and 6*b*2, Xc of FIG. 1A was 9.2 μm and Yc of FIG. 1A was 3.4 μm.

The first and second extending portions 6*a*2 and 6*b*2 and the facing portions 6*a*1 and 6*b*1 are subjected to Auger analysis. As a result, it is found that the first and second extending portions 6*a*2 and 6*b*2 and the facing portions 6*a*1 and 6*b*1 are made of carbon.

A cross sectional shape including the third gap 7*b* located between the first extending portion 6*a*2 and the second extending portion 6*b*2, of each of the portions (end sections) most distant from the center of the electron-emitting device was observed using a focused ion beam scanning electron microscope (FIB-SEM). At this time, the presence of the second concave portion 9*b* could not be clearly determined. The end sections of the first and second extending portions 6*a*2 and 6*b*2 were in a state in which whether or not the first extending portion 6*a*2 and the second extending portion 6*b*2 are separated from each other by the third gap 7*b* is unknown (state in which it is difficult to determine second gap 7*b*).

A cross sectional shape including the second gap 7*a* located between the facing portions 6*a*1 and 6*b*1 was observed. As a result, the presence of the first concave portion 9*a* was determined and it was determined that the depth thereof was 20 nm to 50 nm.

(Step-g)

Subsequently, the substrate 1 was exposed to an air atmosphere and immersed in a 0.4% hydrofluoric acid aqueous solution for one minute, and then cleaned with deionized water for 5 minutes to remove the hydrofluoric acid aqueous solution.

After the procedure described above, the cross sectional shape including the third gap 7*b* located between the first and second extending portions 6*a*2 and 6*b*2 was observed using the FIB-SEM. As a result, it was observed that the second concave portion 9*b* as illustrated in FIG. 1C was formed. The depth of the second concave portion 9*b* was 50 nm to 80 nm. The cross sectional shape including the second gap 7*a* located between the facing portions 6*a*1 and 6*b*1 was observed. As a result, it was determined that the depth of the first concave portion 9*a* was increased to 50 nm to 80 nm. It was determined that, in the end sections of the first and second extending portions 6*a*2 and 6*b*2, the first extending portion 6*a*2 and the second extending portion 6*b*2 were clearly separated from each other by the third gap 7*b*.

(Step-h)

Next, the stabilization operation was performed. The stabilization step was performed in the vacuum processing apparatus as illustrated in FIG. 4 at a baking temperature of 250° C. for 10 hours, and then completed. Then, while the baking temperature returns to a room temperature, the vacuum processing apparatus was evacuated to adjust the degree of vacuum to $2.8\times10^{-8}$ Pa.

After that, a pulse voltage (16 V/1 msec.) was applied between the first and second electrodes 2 and 3 at a frequency of 60 Hz. In order to measure a leak current, a pulse (5V/100 μsec.) was set in the end of the pulse voltage to form a stepped pulse. The anode was provided above the electron-emitting device at a distance of 2 mm therefrom and applied with a voltage of 1 kV. As a result obtained by measurement, the leak current was approximately 1.1 μA, the initial device current If was approximately 1.2 mA, and the initial emitting current Ie was approximately 3.5 μA. The electron-emitting efficiency η was as large as approximately 0.29%. The emitting current value was stable because of a small fluctuation.

With regard to the electron-emitting device manufactured without the operation using the aqueous solution containing hydrogen fluoride, which is performed in Step-g, the leak current was approximately 6.3 μA, the initial device current If was approximately 2.3 mA, the initial emitting current Ie was approximately 5.1 μA, and the electron-emitting efficiency η was approximately 0.22%.

Therefore, when the operation using the aqueous solution containing hydrogen fluoride was performed, the reduction in leak current, an improvement of the electron-emitting efficiency η by approximately slightly more than 30%, and the increase in emitting current Ie were found.

Example 2

An electron-emitting device manufactured in this example is different from Example 1 in that the passivation layer 8 is not used. Hereinafter, a method of manufacturing the electron-emitting device according to this example is described step by step with reference to FIGS. 2A to 2E.

(Step-a)

A quartz glass substrate was sufficiently cleaned with deionized water and an organic solvent to prepare the substrate 1.

Step-b to Step-d were performed in the same manner as in Example 1.

Step-e and Step-f were performed in the same manner as in Example 1, except that the peak was adjusted to ±15 V.

After the steps, an observation using an optical microscope was performed. As a result, it was determined that the electron-emitting device having the structure schematically illustrated in FIG. 1A was obtained. In the first and second extending portions 6*a*2 and 6*b*2, Xc of FIG. 1A was 9.2 μm and Yc of FIG. 1A was 3.2 μm.

The first and second extending portions 6*a*2 and 6*b*2 and the facing portions 6*a*1 and 6*b*1 were subjected to Auger analysis. As a result, it was found that the first and second extending portions 6*a*2 and 6*b*2 and the facing portions 6*a*1 and 6*b*1 were made of carbon.

The cross sectional shape including the third gap 7*b* located between the first extending portion 6*a*2 and the second extending portion 6*b*2, of each of the portions (end sections) most distant from the center of the electron-emitting device was observed using the FIB-SEM. At this time, the presence of the second concave portion 9*b* could not be clearly determined. The end sections of the first and second extending portions 6*a*2 and 6*b*2 were in the state in which whether or not the first extending portion 6*a*2 and the second extending portion 6*b*2 are separated from each other by the third gap 7*b* is unknown (state in which it is difficult to determine second gap 7*b*).

The cross sectional shape including the second gap 7*a* located between the facing portions 6*a*1 and 6*b*1 was observed. As a result, the presence of the first concave portion 9*a* was determined and it was determined that the depth thereof was 30 nm to 40 nm.

Step-g was also performed in the same manner as in Example 1. After that, the cross sectional shape including the third gap 7*b* located between the first and second extending portions 6*a*2 and 6*b*2 was observed using the FIB-SEM. As a result, it was observed that the second concave portion 9*b* as illustrated in FIG. 1C was formed. It was determined that the depth of the second concave portion 9*b* was 45 nm to 90 nm. The cross sectional shape including the second gap 7*a* located between the facing portions 6*a*1 and 6*b*1 was observed. As a result, it was determined that the depth of the first concave portion 9*a* was increased to 45 nm to 90 nm. It was determined that, in the end sections of the first and second extending portions 6*a*2 and 6*b*2, the first extending portion 6*a*2 and the second extending portion 6*b*2 were clearly separated from each other by the third gap 7*b*.

Step-h was also performed as the stabilization operation in the same manner as in Example 1.

After that, a pulse voltage (15 V/1 msec.) was applied between the first and second electrodes 2 and 3 at a frequency of 60 Hz. In order to measure a leak current, a pulse (5V/100 μsec.) was set in the end of the pulse voltage to form a stepped pulse. The anode was provided above the electron-emitting device at a distance of 2 mm therefrom and applied with a voltage of 1 kV. As a result obtained by measurement, the leak current was approximately 1.0 μA, the initial device current If was approximately 1.1 mA, and the initial emitting current Ie was approximately 3.2 μA. The electron-emitting efficiency η was as large as approximately 0.29%. The emitting current value was stable because of a small fluctuation.

With regard to the electron-emitting device manufactured without the operation using the aqueous solution containing hydrogen fluoride, which is performed in Step-g, the leak current was approximately 6.1 μA, the initial device current If was approximately 2.4 mA, the initial emitting current Ie was approximately 5.0 μA, and the electron-emitting efficiency η was approximately 0.21%.

Therefore, when the operation using the aqueous solution containing hydrogen fluoride was performed, the reduction in leak current, an improvement of the electron-emitting efficiency η by approximately slightly more than 40%, and the increase in emitting current Ie were found.

Example 3

Figure 9:
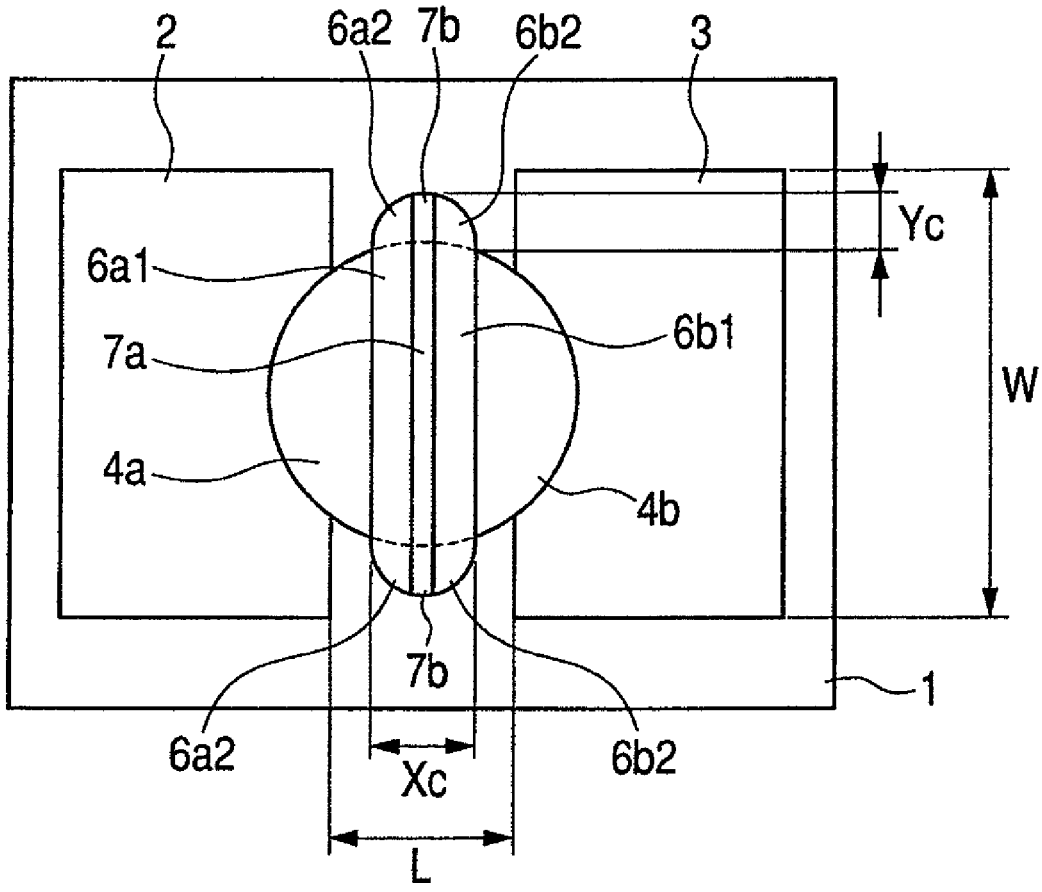
FIG. 9 is a schematic view illustrating an electron-emitting device according to Example 3.

FIG. 9 is an explanatory view illustrating an electron-emitting device according to this example.

The electron-emitting device according to this example is different from that of Example 1 in that the conductive film 4 of the electron-emitting device according to Example 1 was formed by an ink-jet process and the passivation layer 8 was formed using a polysilazane solution. Others are fundamentally performed in the same manner as in Example 1.

Hereinafter, a method of manufacturing the electron-emitting device according to this example is described step by step with reference to FIG. 9 and FIGS. 2A to 2E.

(Step-a)

A glass substrate made of soda lime glass was sufficiently cleaned with a cleaning solution, deionized water, and an organic solvent. The polysilazane solution, Aquamica (produced by AZ Electronic Materials, NN110-20) was spin-applied onto the glass substrate for 30 seconds at 2,000 revolutions/minute. Subsequently, the glass substrate was dried at 100° C. for 10 minutes and then baked in an atmosphere of atmospheric pressure containing water at 500° C. for one hour. Therefore, the substrate 1 provided with the passivation layer (silicon oxide layer) 8 having a thickness of approximately 380 nm was manufactured (FIG. 2A).

(Step-b)

The first and second electrodes 2 and 3 were formed on the substrate 1 by the same manufacturing method as in Example 1 (FIG. 2B). The interval L between the first and second electrodes 2 and 3 was set to 30 μm and the width W thereof was set to 300 μm.

(Step-c)

In order to connect the first and second electrodes 2 and 3 to each other, an aqueous solution containing Pd was applied between the first and second electrodes 2 and 3 using a bubble-jet (registered trademark) type ink-jet apparatus. The aqueous solution contains palladium acetate monoethanolamine complex (0.15 Pd mass %), isopropyl alcohol (15 mass %), ethylene glycol (1 mass %), and polyvinyl alcohol (0.05 mass %).

After that, the substrate 1 was baked at 350° C. for 30 minutes to form the conductive film 4 (FIG. 2C). The conductive (Pd) film 4 having a film thickness of approximately 10 nm was formed into a circular shape having a diameter of approximately 80 μm.

(Step-d)

The energization forming operation was performed by the same method as in Example 1 (FIG. 2D).

(Step-e)

Subsequently, the same activation operation as in Example 1 was performed. In this example, the tolunitrile gas pressure was set to $1.0\times10^{-4}$ Pa and the peak was set to ±18 V.

(Step-f)

Subsequently, similarly to Example 1, tolunitrile was introduced into the vacuum container 45 again at a pressure ($2.7\times10^{-3}$ Pa) higher than the pressure in Step-e. Then, a pulse voltage was applied between the first and second electrodes 2 and 3 for 20 minutes (FIG. 2E). An applied waveform and peak of the pulse voltage are the same as in Step-e.

After the procedure described above, the electron-emitting device was observed using an optical microscope. As a result, it was determined that the electron-emitting device having the structure schematically illustrated in FIG. 9 was obtained. In the first and second extending portions 6*a*2 and 6*b*2, Xc of FIG. 1A was approximately 10.2 μm and Yc of FIG. 1A was approximately 3.5 μm.

The first and second extending portions 6*a*2 and 6*b*2 and the facing portions 6*a*1 and 6*b*1 were subjected to Auger analysis. As a result, it was found that the first and second extending portions 6*a*2 and 6*b*2 and the facing portions 6*a*1 and 6*b*1 were made of carbon.

The cross sectional shape including the third gap 7*b* located between the first extending portion 6*a*2 and the second extending portion 6*b*2, of each of the portions (end sections) most distant from the center of the electron-emitting device was observed using the FIB-SEM. At this time, the presence of the second concave portion 9*b* could not be clearly determined. The end sections of the first and second extending portions 6*a*2 and 6*b*2 were in the state in which whether or not the first extending portion 6*a*2 and the second extending portion 6*b*2 are separated from each other by the third gap 7*b* is unknown (state in which it is difficult to determine second gap 7*b*).

The cross sectional shape including the second gap 7*a* located between the facing portions 6*a*1 and 6*b*1 was observed. As a result, the presence of the first concave portion 9*a* was determined and it was determined that the depth thereof was 20 nm to 50 nm.

(Step-g)

Subsequently, the electron-emitting device was exposed to an air atmosphere and immersed in a 0.4% hydrofluoric acid aqueous solution for one minute, and then cleaned with deionized water for 5 minutes to remove the hydrofluoric acid aqueous solution.

After the procedure described above, the cross sectional shape including the third gap 7*b* located between the first and second extending portions 6*a*2 and 6*b*2 was observed using the FIB-SEM. As a result, it was observed that the second concave portion 9*b* as illustrated in FIG. 1C was formed. The depth of the second concave portion 9*b* was 50 nm to 100 nm. The cross sectional shape including the second gap 7*a* located between the facing portions 6*a*1 and 6*b*1 was observed. As a result, it was determined that the depth of the first concave portion 9*a* was increased to 60 nm to 110 nm. It was determined that, in the end sections of the first and second extending portions 6*a*2 and 6*b*2, the first extending portion 6*a*2 and the second extending portion 6*b*2 were clearly separated from each other by the third gap 7*b*.

(Step-h)

Next, the stabilization operation was performed in the same manner as in Example 1.

After that, a pulse voltage (18 V/1 msec.) was applied between the first and second electrodes 2 and 3 at a frequency of 60 Hz. In order to measure a leak current, a pulse (5V/100 μsec.) was set in the end of the pulse voltage to form a stepped pulse. The anode was provided above the electron-emitting device at a distance of 2 mm therefrom and applied with a voltage of 1 kV. As a result obtained by measurement, the leak current was approximately 0.8 μA, the initial device current If was approximately 1.0 mA, and the initial emitting current Ie was approximately 3.1 μA. The electron-emitting efficiency η was as large as approximately 0.31%. The emitting current value and the device current value were stable because of a small fluctuation.

With regard to the electron-emitting device manufactured without the operation using the aqueous solution containing hydrogen fluoride, which is performed in Step-g, the leak current was approximately 6.6 μA, the initial device current If was approximately 2.1 mA, the initial emitting current Ie was approximately 4.9 μA, and the electron-emitting efficiency η was approximately 0.23%.

Therefore, when the operation using the aqueous solution containing hydrogen fluoride was performed, the reduction in leak current, an improvement of the electron-emitting efficiency η by approximately slightly more than 30%, and the increase in emitting current Ie were found.

Example 4

Figure 10A:
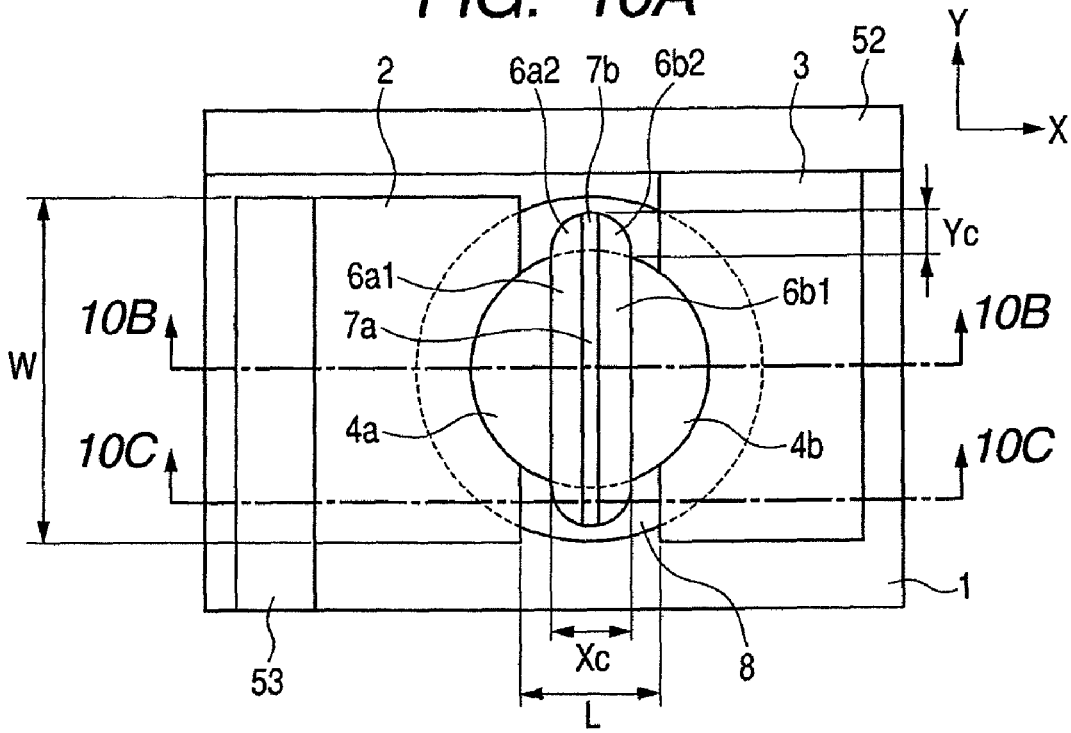
FIGS. 10A, 10B, and 10C are schematic views illustrating an electron-emitting device according to Example 5.
Figure 10B:
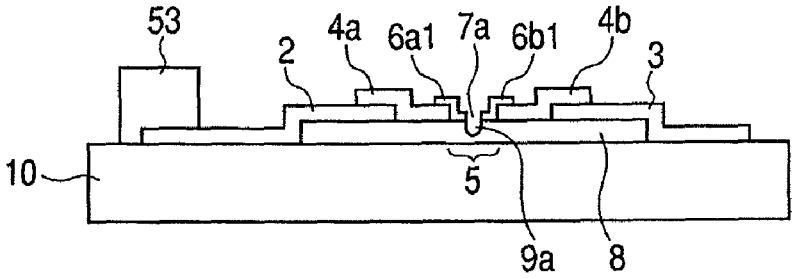
Figure 10C:
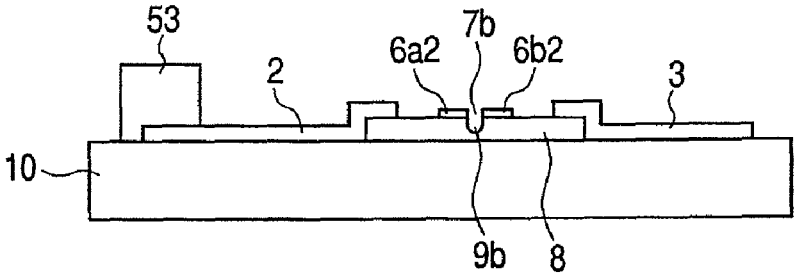

In this example, the image display apparatus schematically illustrated in FIG. 7 was manufactured using the electron source schematically illustrated in FIG. 6, in which the large number of electron-emitting devices are arranged in matrix. FIGS. 10A, 10B, and 10C are enlarged schematic views illustrating a portion of an electron-emitting device according to this example. FIG. 10A is a plan view. FIG. 10B is a cross sectional view along a 10B-10B line of FIG. 10A. FIG. 10C is a cross sectional view along a 10C-10C line of FIG. 10A.

In this example, multiple pairs of first and second electrodes 2 and 3 were formed by the same steps as Step-a and Step-b in Example 3, and then conventional known matrix wirings were formed. After that, Step-c to Step-g in Example 3 were performed in order and sealing was performed using a face plate and a support frame under a vacuum atmosphere to manufacture a display panel.

A method of manufacturing an electron source substrate according to this example is described more detail in the step order. Note that Step-a to Step-g described below are substantially the same steps as in Example 3.

(Step-a)

A glass substrate made of glass for plasma display (produced by Asahi Glass Co. Ltd., PD200) was sufficiently cleaned with a cleaning solution, deionized water, and an organic solvent. Then, a polysilazane solution, Aquamica (produced by AZ Electronic Materials, NN110-20) was applied onto the glass substrate by an ink-jet process. Positions to be applied were separately set for respective areas for forming the electron-emitting devices. Subsequently, the glass substrate was dried at 100° C. for 10 minutes and then baked in an atmosphere of atmospheric pressure containing water at 550° C. for one hour. Therefore, the passivation layers (Na blocking layers) 8 each of which has a diameter of 120 μm and an average film thickness of 350 nm within a region with a radius of 50 μm from the center and is made of silicon oxide were formed.

(Step-b)

N pairs of first and second electrodes 2 and 3 which are located in the X axis and m pairs of first and second electrodes 2 and 3 which are located in the Y axis were formed on the substrate 1 by the same method as in Example 1 (m and n each indicate positive integer). The interval L between the first and second electrodes 2 and 3 was set to 20 μm and the width W thereof was set to 300 μm.

Subsequently, matrix wirings were formed. The matrix wirings include the m X-axis wirings 52 expressed by Dx1, Dx2, . . . , and Dxm. A metal paste material containing Ag as a main ingredient was printed by a screen printing process and baked at 480° C. for 10 minutes to form the matrix wirings.

An interlayer insulating layer (not shown) was provided in regions in which the m X-axis wirings 52 are to be overlapped with the n Y-axis wirings 53, to electrically separate the m X-axis wirings 52 from the n Y-axis wirings 53.

A glass material which contains lead oxide and is formed by a screen printing process was used for the interlayer insulating layer (not shown). The interlayer insulating layer (not shown) was baked at approximately 480° C. for 20 minutes. The printing and baking were repeated two times to form two laminated layers. The Y-axis wirings 53 which are the n wirings Dy1, Dy2, . . . , and Dyn were also formed in the same manner as the X-axis wirings 52.

(Step-c)

An aqueous solution containing Pd was applied between the first and second electrodes 2 and 3 of each of the electron-emitting devices by the same method as in Example 3 to form the conductive (Pd) films 4 each having a film thickness of approximately 10 nm into a circular shape having a diameter of approximately 80 μm. Each of the Pd films was provided within a region of each of the passivation layers 8 formed in Step-a.

(Step-d)

An energization forming operation was performed between the first and second electrodes 2 and 3 through the wirings Dx1 and Dy1 illustrated in FIG. 6 under the same condition as in Example 3. During the energization forming operation, a pulse waveform was successively applied to the wirings Dx1 to Dxm. In this case, the wirings Dy1 to Dyn were grounded.

(Step-e)

The activation operation was performed under the same conditions as in Example 3.

(Step-f)

Subsequently, similarly to Example 3, tolunitrile was introduced into the vacuum container 45 again at a pressure ($2.7\times10^{-3}$ Pa) higher than the pressure in Step-e. Then, a pulse voltage was applied between the first and second electrodes 2 and 3 for 20 minutes. An applied waveform and peak of the pulse voltage were the same as in Step-e.

After the procedure described above, the electron-emitting device was observed using an optical microscope. As a result, in the first and second extending portions 6*a*2 and 6*b*2, Xc of FIG. 1A was 9.5 μm in average and Yc of FIG. 1A was 3.4 μm in average.

The first and second extending portions 6*a*2 and 6*b*2 and the facing portions 6*a*1 and 6*b*1 were subjected to Auger analysis. As a result, it was found that the first and second extending portions 6*a*2 and 6*b*2 and the facing portions 6*a*1 and 6*b*1 were made of carbon.

The cross sectional shape including the third gap 7*b* located between the first extending portion 6*a*2 and the second extending portion 6*b*2, of each of the portions (end sections) most distant from the center of the electron-emitting device was observed using the FIB-SEM. At this time, the presence of the second concave portion 9*b* could not be clearly determined. The end sections of the first and second extending portions 6*a*2 and 6*b*2 were in the state in which whether or not the first extending portion 6*a*2 and the second extending portion 6*b*2 are separated from each other by the third gap 7*b* is unknown (state in which it is difficult to determine second gap 7*b*).

The cross sectional shape including the second gap 7*a* located between the facing portions 6*a*1 and 6*b*1 was observed. As a result, the presence of the first concave portion 9*a* was determined and it was determined that the depth thereof was 20 nm to 50 nm.

(Step-g)

Subsequently, the electron source substrate was exposed to an air atmosphere and immersed in a 0.4% hydrofluoric acid aqueous solution for one minute, and then cleaned with deionized water for 5 minutes to remove the hydrofluoric acid aqueous solution.

After the procedure described above, the cross sectional shape including the third gap 7*b* located between the first and second extending portions 6*a*2 and 6*b*2 was observed using the FIB-SEM. As a result, it was observed that the second concave portion 9*b* as illustrated in FIG. 1C was formed. The depth of the second concave portion 9*b* was 50 nm to 100 nm. The cross sectional shape including the second gap 7*a* located between the facing portions 6*a*1 and 6*b*1 was observed. As a result, it was determined that the depth of the first concave portion 9*a* was increased to 60 nm to 110 nm. It was determined that, in the end sections of the first and second extending portions 6*a*2 and 6*b*2, the first extending portion 6*a*2 and the second extending portion 6*b*2 were clearly separated from each other by the third gap 7*b*.

(Step-h)

Next, the stabilization operation was performed in the same manner as in Example 3.

(Step-i)

Next, the thus manufactured electron source substrate 51 in which the multiple conductive films 4 are arranged in matrix and the face plate 66 provided with the fluorescent film 64 and the metal back 65 on the glass substrate 63 were used to manufacture an image display panel (FIG. 7). In FIG. 7, the electron source substrate 51 and the rear plate 61 are illustrated as separate members. However, the substrate 1 serves as both the electron source substrate 51 and the rear plate 61 in this example.

Then, the container external terminals Dx1 to Dxm and Dy1 to Dyn and the high-voltage terminal 67 of the image display panel were connected to driver circuits to complete an image display apparatus.

Scanning signals and modulation signals were applied from signal generation units (not shown) to the respective electron-emitting devices through the container external terminals Dx1 to Dxm and Dy1 to Dyn, to emit electrons. Then, a high voltage equal to or larger than several kV was applied to the metal back 65 through the high-voltage terminal 67 so that the emitted electrons were collided with the fluorescent film 64 to emit light, thereby displaying an image.

As a result, the image display apparatus according to this example could display an image having high luminance and uniformity for a long period with low power consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-168752, filed Jun. 27, 2008, which is hereby incorporated by reference in its entirety.

What is claimed is:

1. An electron emitting-device, comprising:

a first conductive film and a second conductive film placed on a substrate facing each other and having a first space therebetween;

a first carbon film having one end and a further end, the one end connected to the first conductive film, and the further end interposed in the first space between the first conductive film and the second conductive film; and a second carbon film having one end and a further end, the one end connected to the second conductive film, and the further end of the second carbon film facing the further end of the first carbon film interposing a second space in the first space;

wherein the first carbon film has a base portion and two extending portions, the base portion of the first carbon film having a first length along the Y axis which is equal to a length of a connecting portion of the first conductive film with the first carbon film and each of the extending portions of the first carbon film extending along the Y axis from a side end of the base portion to a far end respectively, so that the first carbon film has a total length along the Y axis longer than the first length and the second carbon film has a base portion and two extending portions, the base portion of the second carbon film having a second length along the Y axis which is equal to a length of a connecting portion of the second conductive film with the second carbon film and at least one extending portion of the second carbon film extending along the Y axis from a side end of the base portion to a far end respectively, so that the second carbon film has a total length along the Y axis longer than the second length, where an X axis is a direction from the first conductive film to the second conductive film, and the Y axis is a direction parallel to a surface of the surface and orthogonal to the X axis, and wherein, in the second space between the first carbon film and the second carbon film, the substrate surface has a concave portion, and the second space and the concave portion are coextending continuously respectively between a pair of the far ends of the extending portions of the first or second carbon film.

2. An electron source comprising the electron emitting-device according to claim 1.

3. An image display apparatus comprising the electron source according to claim 2, and a light-emitting member that emits light by being subjected to the irradiation of the electron emitted from the electron source.

* * * * *